US010506898B2

(12) United States Patent
Herbst

(10) Patent No.: US 10,506,898 B2
(45) Date of Patent: Dec. 17, 2019

(54) BATHTUB TABLE

(76) Inventor: Maureen P. Herbst, East Northport, NY (US)

( * ) Notice: Subject to any disclaimer, the term of this patent is extended or adjusted under 35 U.S.C. 154(b) by 0 days.

(21) Appl. No.: 11/298,353

(22) Filed: Dec. 9, 2005

(65) Prior Publication Data

US 2007/0130681 A1 Jun. 14, 2007

(51) Int. Cl.
*A47K 3/00* (2006.01)

(52) U.S. Cl.
CPC ..... *A47K 3/004* (2013.01)

(58) Field of Classification Search
CPC ..... A47K 3/00
USPC ..... 4/559, 579, 572.1; 108/42, 47
See application file for complete search history.

(56) References Cited

U.S. PATENT DOCUMENTS

| | | | | |
|---|---|---|---|---|
| 2,547,564 | A * | 4/1951 | Burke | 4/572.1 |
| 3,213,565 | A * | 10/1965 | Grosz | 4/559 |
| 3,458,876 | A * | 8/1969 | Struthers | 4/579 |
| 4,148,264 | A * | 4/1979 | Caravias | 108/145 |
| 5,761,753 | A * | 6/1998 | Talbert | 4/559 |
| 6,257,535 | B1 * | 7/2001 | Jaing | 248/205.5 |
| 6,301,724 | B1 * | 10/2001 | Wright | 4/559 |
| 7,284,735 | B1 * | 10/2007 | Khosropour et al. | 248/226.11 |
| 8,276,526 | B2 * | 10/2012 | Verweij | 108/147 |
| 2002/0020797 | A1 * | 2/2002 | Artz | 248/424 |
| 2006/0145036 | A1 * | 7/2006 | Jones et al. | 248/188.5 |
| 2007/0252068 | A1 * | 11/2007 | Secora | 248/458 |
| 2011/0147547 | A1 * | 6/2011 | Fitzpatrick et al. | 248/157 |
| 2012/0126072 | A1 * | 5/2012 | Pettersson | 248/157 |

* cited by examiner

*Primary Examiner* — Lori L Baker
(74) *Attorney, Agent, or Firm* — Philip Weiss; Weiss & Weiss

(57) ABSTRACT

The present invention relates to a table that can be placed in a bathtub, remain stationary in the bathtub, and be used by the occupant of the bathtub.

2 Claims, 4 Drawing Sheets

BATHTUB TABLE

FIELD OF THE INVENTION

The present invention relates to a table that can be placed in a bathtub, remain stationary in the bathtub, and be used by the occupant of the bathtub.

BACKGROUND OF THE INVENTION

Children enjoy playing with games and toys in the bathtub. However, there is no place to put the games and toys in the bathtub. Most people leave the games and toys outside the bath and bring the games and toys in when necessary. This creates a hazard as the occupant of the bathtub can slip or slide on the floor when they leave and enter the bathtub. Further, a parent must continually bring toys into the bathtub since the toys cannot be kept in the bathtub.

SUMMARY OF THE INVENTION

The present invention relates to table which can be used in a bathtub. It is an object of the present invention for the table to comprise a tabletop and four legs.

It is an object of the present invention for the legs to have a means for attaching to the floor or sides of the bathtub.

It is an object of the present invention for the legs to have suction cups on the bottom or side of legs to attach to the floor or side of bathtub.

It is an object of the present invention for table to remain stationary in the bathtub when there is water in the bathtub.

It is an object of the present invention for the table to be made out of plastic.

It is an object of the present invention for the table to have compartments to store toys and games.

It is an object of the present invention for the table to have compartments to store necessities for bathtub such as shampoo, soap and washcloths.

It is an object of the present invention for the tabletop to have holes within it so that any water can drain from the top of the table.

The present invention relates to a tabletop, which can be placed in a bathtub. The tabletop can expand or contract to fit over the sides of the bathtub so that the tabletop can rest on the sides of the bathtub. It is an object of the present invention for the tabletop to have lips fitting over the sides of a bathtub and supporting the tabletop. It is an object of the present invention for the lips to have suction cups so that the tabletop remains stationary.

DETAILED DESCRIPTION OF THE DRAWINGS

Figure 1:
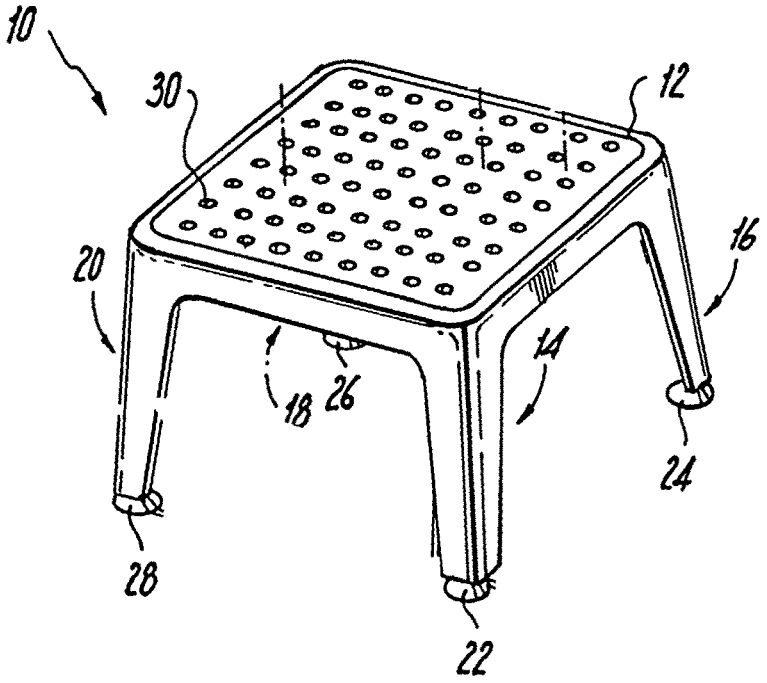
FIG. 1 shows a front view of an embodiment of the present invention.

FIG. 1 shows a bathtub table 10 having a tabletop 12 and legs 14, 16, 18 and 20. Each leg shown in FIG. 1 has a suction cup 22, 24, 26 and 28 attached to the bottom of the legs for attaching the table to the bathtub. The tabletop 12 has holes 30 for allowing drainage of water through the tabletop 12.

Figure 2:
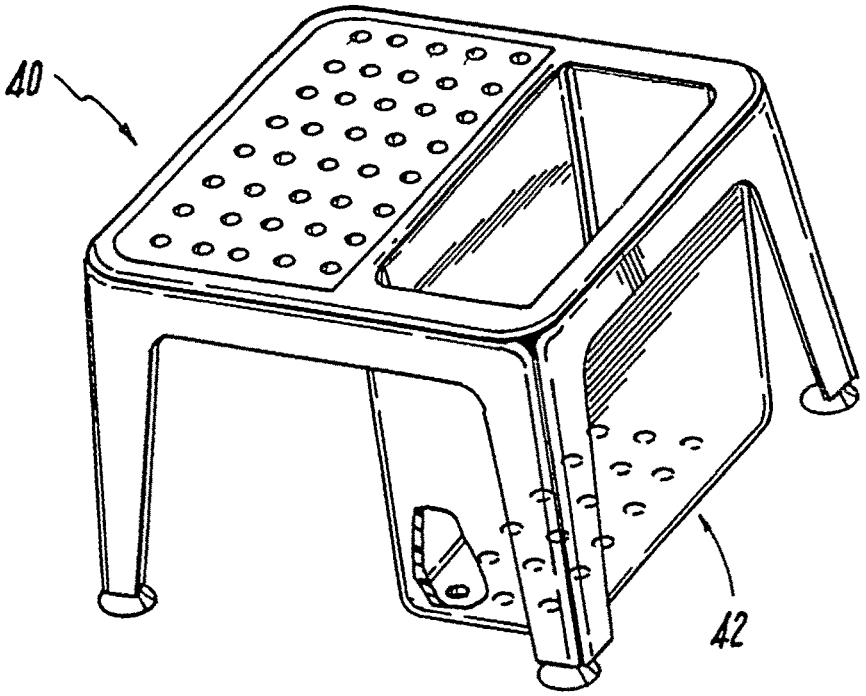
FIG. 2 shows a side view of an embodiment of the present invention.

FIG. 2 shows a bathtub table 40 having a tabletop, legs and suction cups as shown in FIG. 1. Bathtub table 40 also has a compartment 42 which can be used to store bathtub games, toys and other bathtub necessities.

Figure 3:
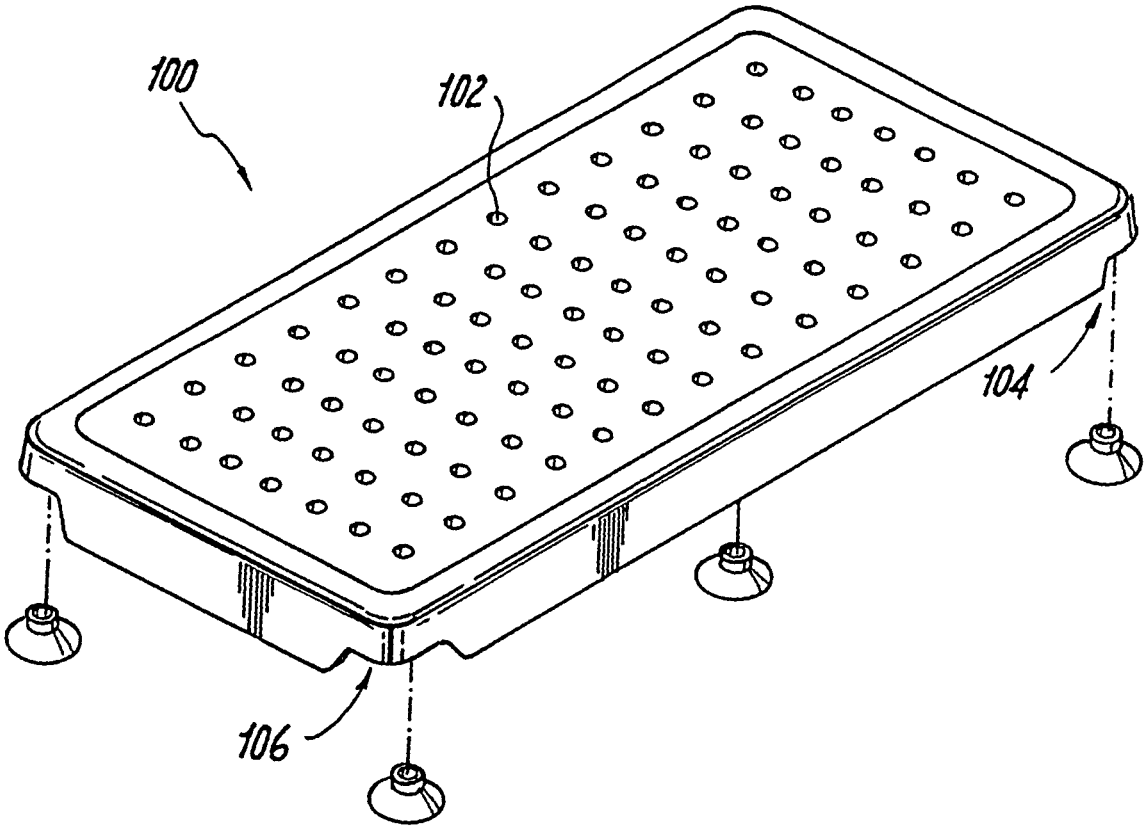
FIG. 3 shows a further embodiment of the present invention.
Figure 4:
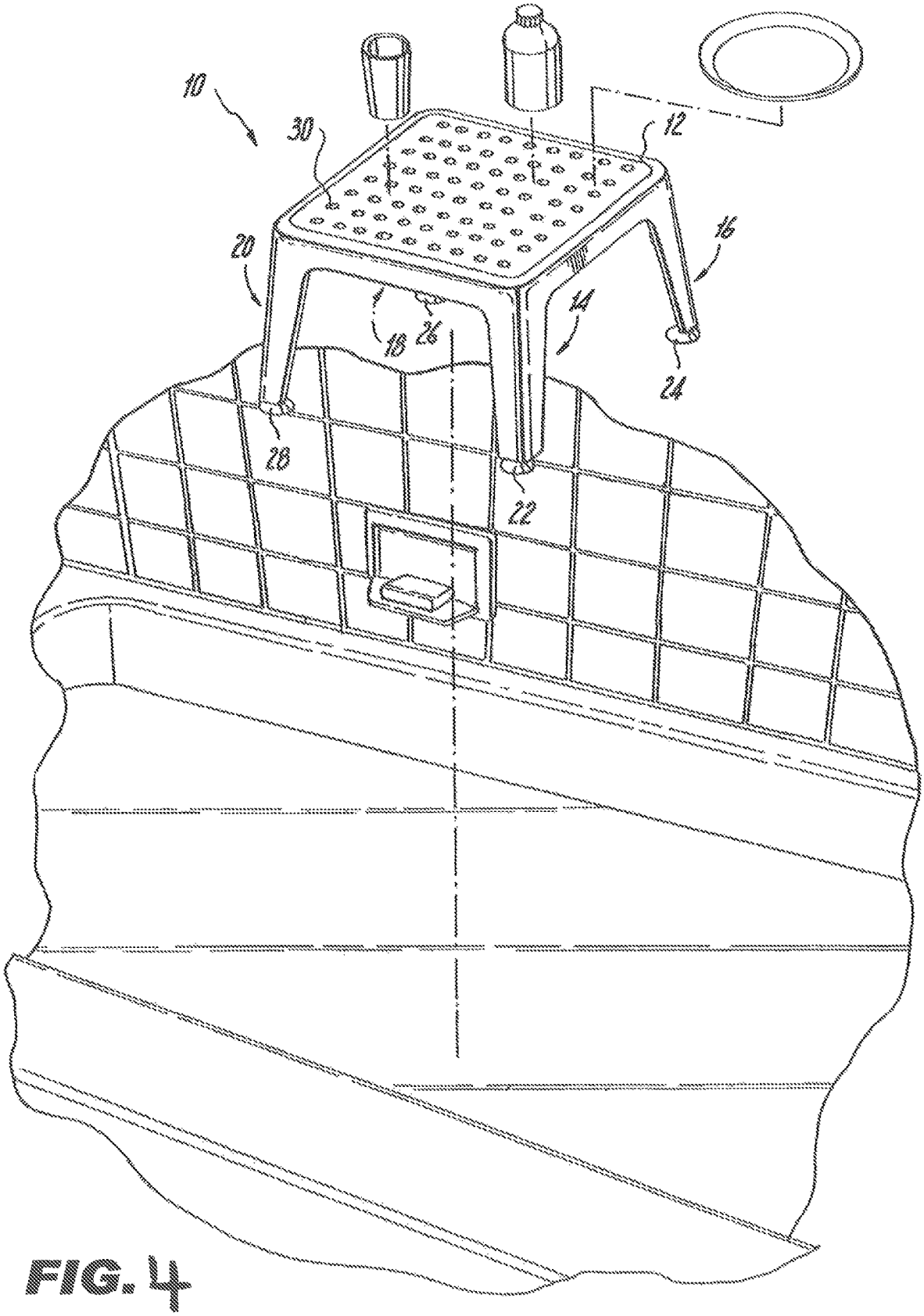
FIG. 4 shows a front view of an embodiment of the present invention.
Figure 5:
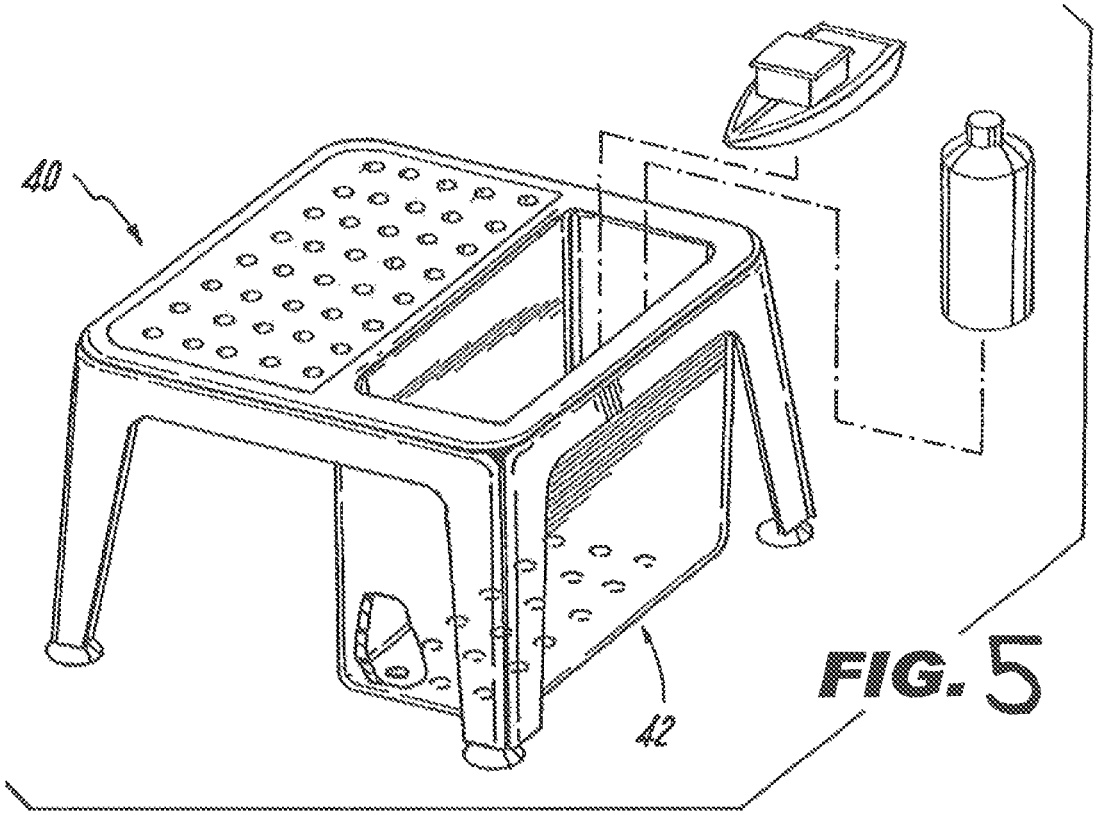
FIG. 5 shows a side view of an embodiment of the present invention.
Figure 6:
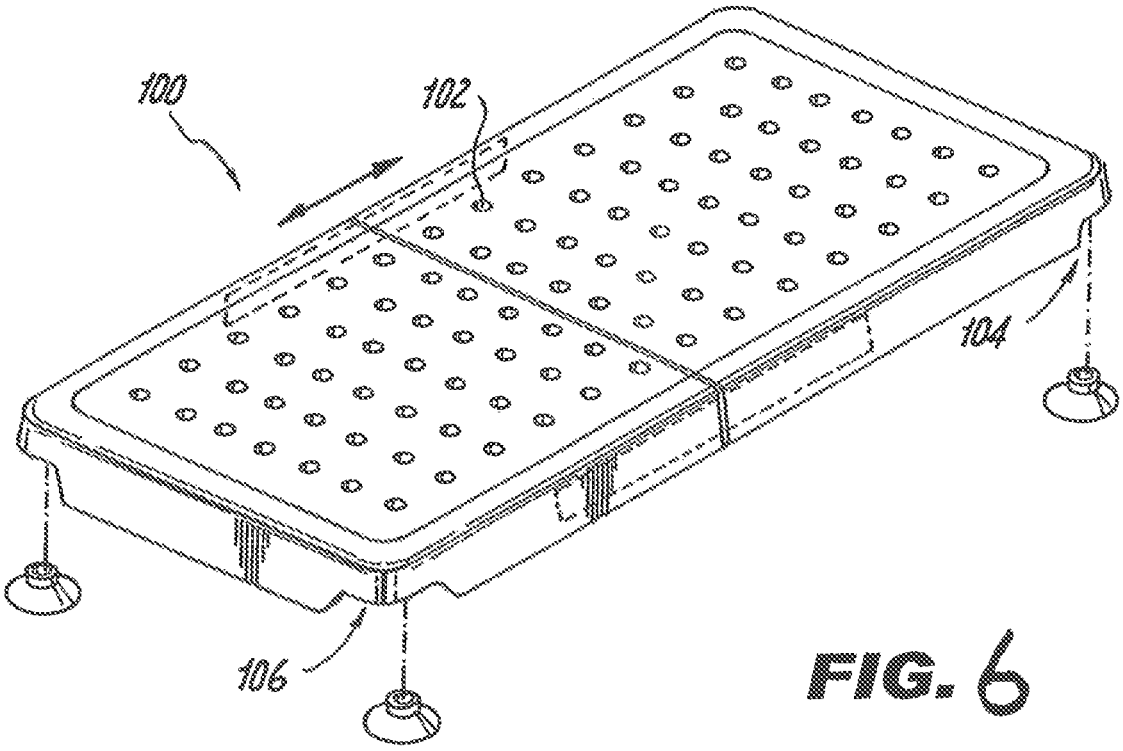
FIG. 6 shows a further embodiment of the present invention.

FIG. 3 shows a further embodiment having a bathtub tabletop 100 having holes 102. The bathtub tabletop has lips 104 and 106 for fitting over the side of a bathtub and supporting the tabletop 100. The lips of the tabletop may optionally have suction cups for attaching to the sides of the bathtub.

The invention claimed is:

1. A table for use in a bathtub comprising:

a table made from plastic having a top surface and a lower surface, said table being a flat tabletop on said top surface, and exactly four legs extending from said lower surface of said flat tabletop, said table including compartments for storage of bathtub games, toys or other bathtub necessities, each of said four legs having suction cups on a bottom or side of said legs for attachment to the bottom or side of said bathtub, wherein said tabletop includes multiple holes for drainage of water through said tabletop, wherein said tabletop sized and configured for expanding and contracting to fit over opposing sides of said bathtub.

2. A bathtub tabletop comprising:

a flat tabletop made from plastic, said tabletop having lips on two opposing sides of said bathtub tabletop, said bathtub tabletop sized and configured for expanding and contracting to fit over the side of a bathtub and where said lips fit over opposite sides of said bathtub, said bathtub tabletop having no legs, said bathtub tabletop includes multiple holes for drainage of water, wherein said lips have suction cups attached thereto.

* * * * *